US005992481A

United States Patent [19]

Smith

[11] Patent Number: 5,992,481

[45] Date of Patent: Nov. 30, 1999

[54] COOLING SYSTEM FILLING AID AND METHOD OF FILLING THE COOLING SYSTEM OF AN INTERNAL COMBUSTION ENGINE

[75] Inventor: Gary M. Smith, Waterford, Mich.

[73] Assignee: Chrysler Corporation, Auburn Hills, Mich.

[21] Appl. No.: 08/989,537

[22] Filed: Dec. 12, 1997

[51] Int. Cl.[6] ..... B67C 11/00

[52] U.S. Cl. ..... 141/326; 141/98; 141/300; 141/331; 141/340; 141/386; 251/7

[58] Field of Search ..... 141/297–300, 141/331, 340, 386, 1, 341–342, 344–345, 383, 98, 326; 251/7; 123/41.54; 165/104.32

[56] References Cited

U.S. PATENT DOCUMENTS

| | | | |
|---|---|---|---|
| D. 205,678 | 9/1966 | Williams . | |
| 918,814 | 4/1909 | Barney . | |
| 955,553 | 4/1910 | Ritten . | |
| 959,715 | 5/1910 | Carson | 141/340 |
| 1,174,553 | 3/1916 | Errington | 141/297 |
| 1,355,952 | 10/1920 | Even . | |
| 1,396,606 | 11/1921 | Vincent . | |
| 2,694,515 | 11/1954 | Green | 141/340 |
| 2,811,181 | 10/1957 | Correll . | |
| 3,177,907 | 4/1965 | Baldi | 141/300 |
| 3,990,489 | 11/1976 | Ruter | 141/386 |
| 4,248,401 | 2/1981 | Mittleman . | |
| 4,434,963 | 3/1984 | Russell . | |
| 4,494,585 | 1/1985 | Waldecker . | |
| 5,026,019 | 6/1991 | Biekart et al. . | |
| 5,111,838 | 5/1992 | Langston | 141/386 |
| 5,445,196 | 8/1995 | Tyree, Jr. | 141/297 |
| 5,680,833 | 10/1997 | Smith . | |
| 5,762,120 | 6/1998 | Smith | 141/340 |

FOREIGN PATENT DOCUMENTS

| | | | |
|---|---|---|---|
| 204746 | 10/1923 | United Kingdom | 141/340 |

*Primary Examiner*—J. Casimer Jacyna
*Attorney, Agent, or Firm*—Kenneth H. Maclean

[57] ABSTRACT

A filling aid for field filling the engine cooling system of automotive vehicles with cooling liquids. For field service, the filling aid is mounted in a stabilized upright orientation by an integral fluid sealing connection to a filler neck of the deareation chamber of a coolant bottle of the system so that it extends above the bottle. Coolant is added into the cooling system through the filling aid until the filling aid and deareation chamber are filled with coolant. Because a taller column of coolant has been established by use of the filling aid, potential energy is increased and coolant is quickly fed by increased pressure and force into the engine cooling system. When sufficient coolant fills the system, any coolant left in the filling aid may be released by removing a closure clamp previously installed on an overflow tube leading from the deareation chamber so that it drains with no spills from the filling aid to an overflow chamber of the coolant bottle.

1 Claim, 5 Drawing Sheets

COOLING SYSTEM FILLING AID AND METHOD OF FILLING THE COOLING SYSTEM OF AN INTERNAL COMBUSTION ENGINE

BACKGROUND OF THE INVENTION

The engine liquid cooling systems of most new automobiles are quickly filled at the manufacturing facility by special power equipment to supply measured quantities of solutions of ethylene glycol antifreeze, corrosion inhibitors, and water. Such coolant solutions provide full engine and coolant system protection over a wide range of temperatures experienced by a vehicle from very cold through extremely hot weather operations. The rust preventing and lubricating agents of the solution further protects the radiator, water pump and other components in the coolant system.

Since the corrosion protection system in the coolant has a finite life, changing the engine coolant in field service is necessary and is generally done by manually adding fluid directly into the system. Such field service, in contrast to powered factory fill, is usually a lengthy and inefficient process. Moreover, if close attention is not observed, such field service may result in an incomplete filling of the cooling system.

When adding coolant solution to a closed engine cooling system in the field, the pressure cap is removed from the filler neck of the radiator or from the deareation chamber of an auxiliary coolant container or bottle and replacement coolant is poured into the filler neck thereof. The space in the radiator or bottle immediately below the filler neck fills up quickly as the added volume of coolant slowly flows into the rest of the cooling system. When the observed level in the radiator or deareation chamber finally recedes to an appropriate level, additional volumes of coolant are added with additional service time spent waiting for the system to become appropriately filled. This prior slow field filling process is even more inefficient when the entire system is drained and replaced by a new solution. In some vehicles, particularly those with stylized low hood lines and where there is minimized space to locate coolant bottles at elevated positions, such field service may take several hours for a complete fill with replacement coolant.

Prior to the present invention, various constructions have been devised to aid in the field servicing of liquid cooling systems for internal combustion engines particularly those in automotive vehicles. For example, U.S. Pat. Nos. 1,396,606 issued Nov. 8, 1921, and 2,811,181 issued Oct. 29, 1957, are drawn to special funnel constructions for aid in directly filling automotive radiators with vent pipes with liquid coolant. U.S. Pat. No. 4,494,585, issued Jan. 22, 1985, is drawn to a specialized funnel having a primary vent and an auxiliary vent/siphon aid for use in adding coolant to radiators having filling openings which are inclined to the vertical plane.

While these prior constructions provide advantages in adding coolant to automotive cooling systems with reduced spillage, they do not meet higher standards for field service with improving the flow rate of coolant to the system of an internal combustion engine to materially reduce fill time. Moreover, these prior constructions do not provide for removal of the filling aid from the filler neck of the coolant system with substantially no spillage after the system has been filled.

BRIEF SUMMARY OF THE INVENTION

The present invention is drawn to a new and improved field filling aid for quickly filling the engine cooling system of vehicles with cooling fluids, particularly where the cooling system configuration makes it difficult to quickly fill without power equipment. The present invention is further drawn to a new and improved method for efficiently filling the liquid coolant system of automotive internal combustion engines without the use of specialized power equipment. This invention in effect provides for the advantageous increase in the height of the column of liquid coolant available for filling the cooling system. The invention includes a special elevated coolant filling aid locked in a fluid sealed and stabilized upright position onto the fill neck and above the overflow tube or pipe of the deareation chamber or other component of the engine cooling system. With the filling aid located substantially above the deareation chamber and the other portions of the coolant system, the potential energy of the fluid added to the filling aid provides the additional force to effect the rapid flow of the fluid through the system thereby substantially increasing system fill efficiency.

In one preferred method a mechanic or a person of ordinary mechanical skill easily attaches the cooling system filling aid to the filler neck of the coolant bottle and uses a clip or any suitable clamping device to pinch off and fully close the overflow hose leading therefrom. Coolant is added to the filling aid until the filling aid becomes filled with coolant and coolant flows into the system. Because a taller column of coolant now exists through the use of the filling aid, adequate pressure is present so coolant is forced quickly into the engine and the rest of the engine cooling system. When the service person has finally poured sufficient coolant into the filling aid to completely fill the system, the easily observed coolant level in the filling aid will remain constant.

Any coolant remaining in the filling aid is discharged therefrom by removing the clip from the overflow tube so that the tube is opened and the coolant drains through the overflow tube into the overflow chamber rather then spilling on to the service person or contaminating the ground or other surface. This invention accordingly eliminates coolant spillage particularly during the time when the filling aid is removed from the filler neck. After the filling aid is removed, a conventional pressure cap is replaced onto the fill neck of the deareation chamber so that the cooling system operates as designed. With this invention full field service for completely filling this cooling system may be completed in approximately five minutes in a system that previously required several hours for complete filling.

DETAILED DESCRIPTION OF THE PREFERRED EMBODIMENT

Figure 1:
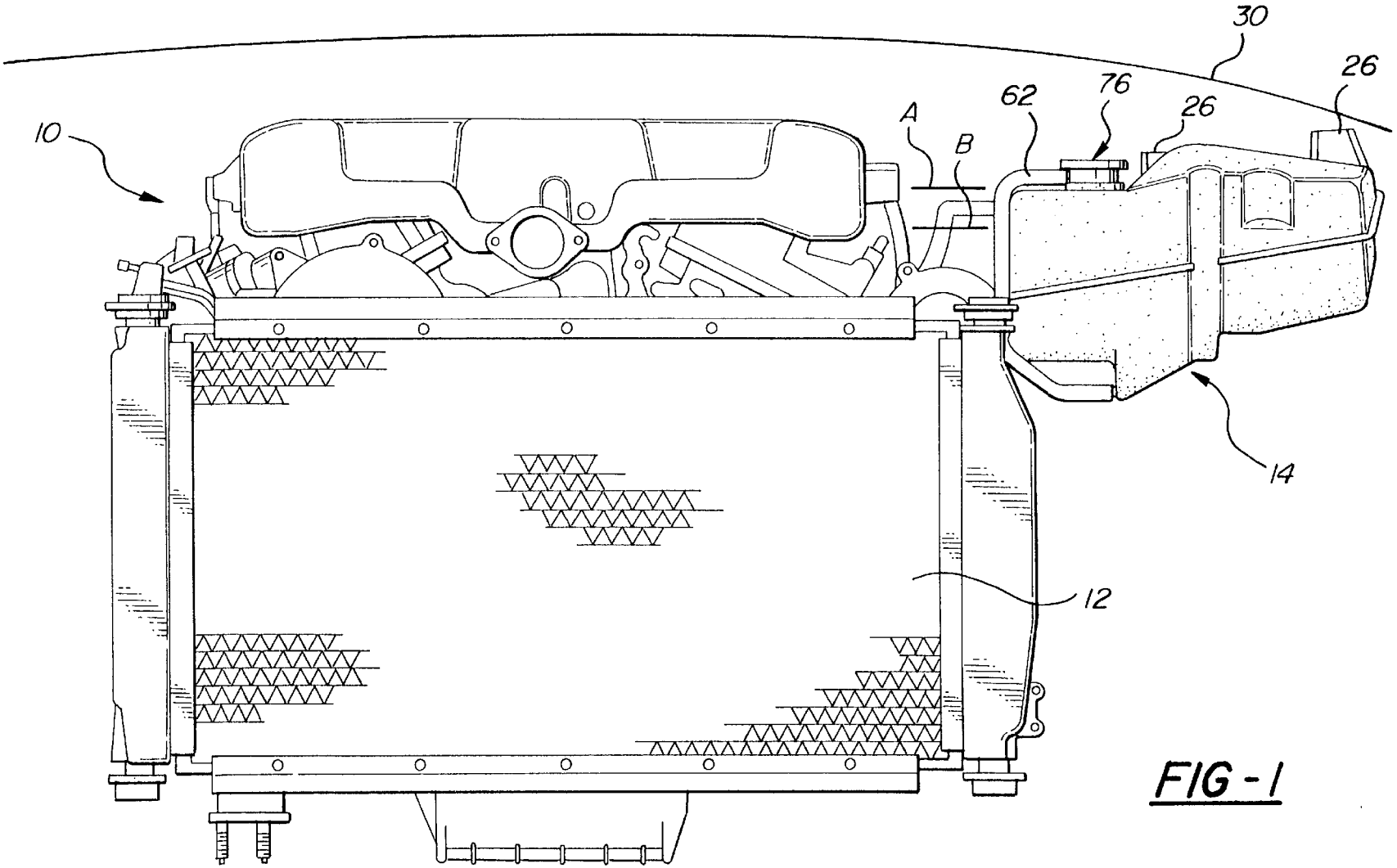
FIG. 1 is a front elevation view of a liquid cooled internal combustion engine with the an associate coolant bottle as installed in the engine compartment of an automotive vehicle.
Figure 3A:
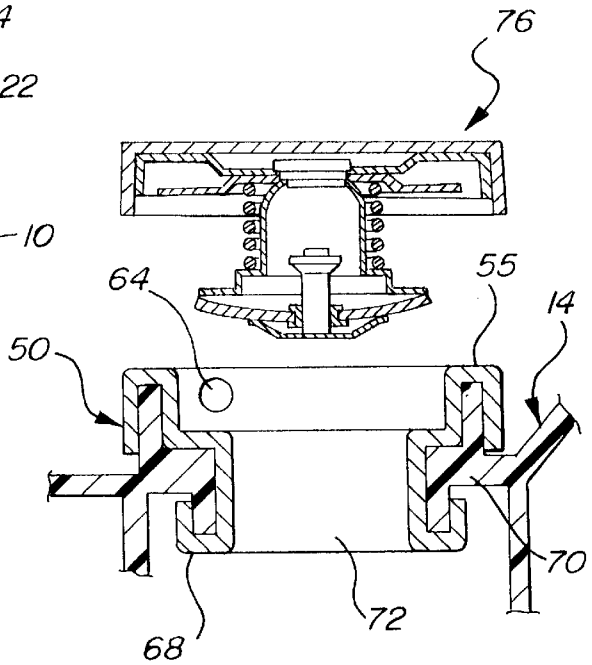
FIG. 3A is a sectional view of a coolant pressure cap for the system of FIG. 3.
Figure 2:
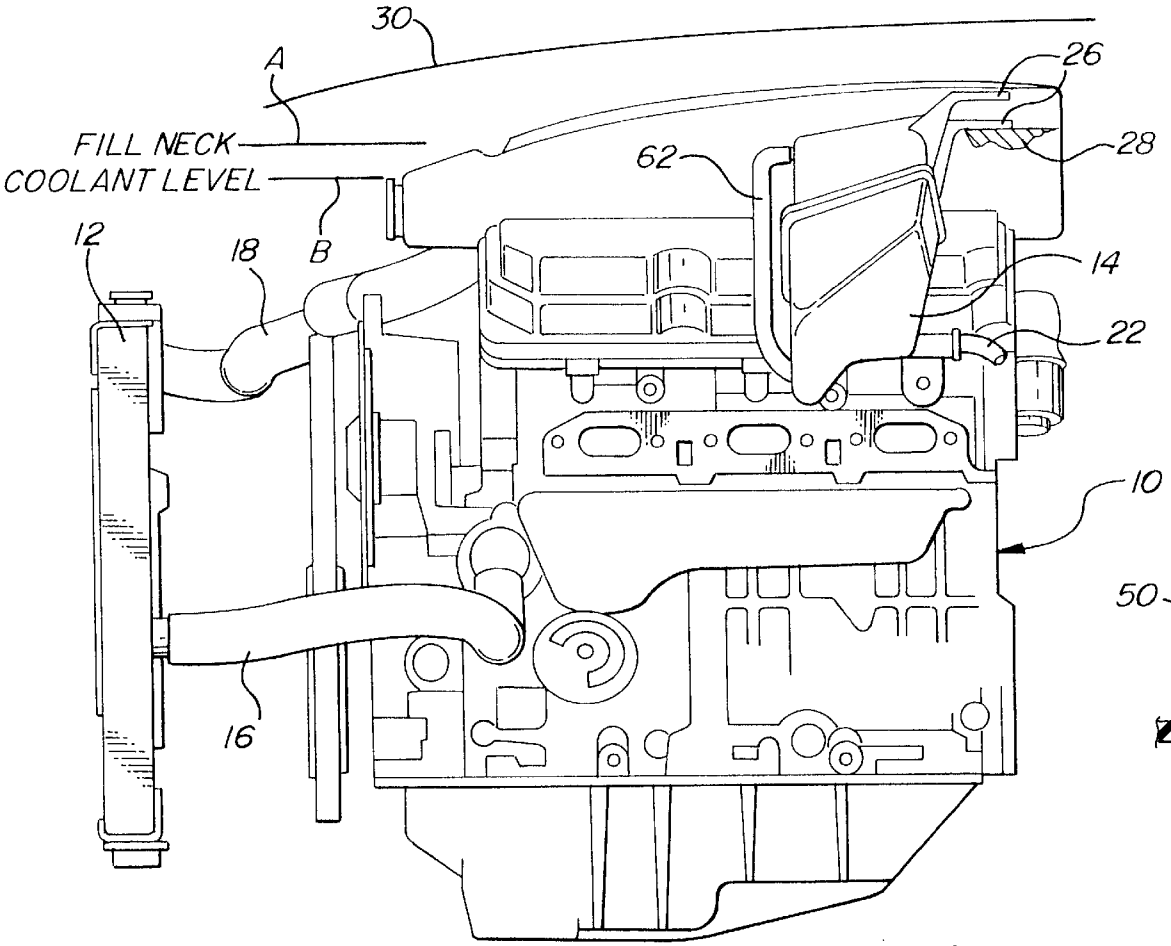
FIG. 2 is a side elevation view with parts removed of the engine and coolant bottle of FIG. 1.
Figure 3:
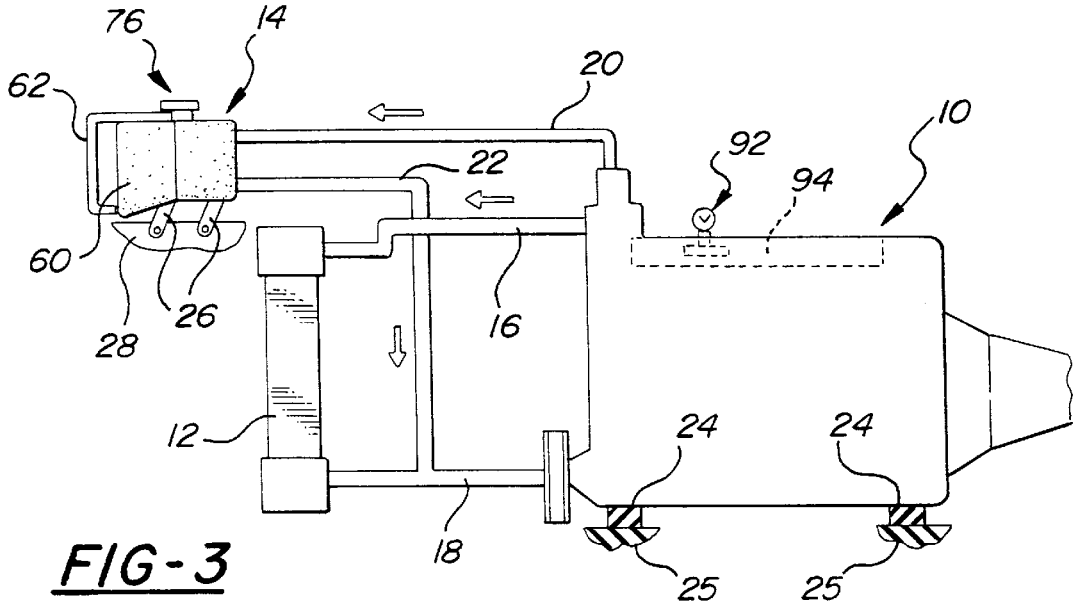
FIG. 3 is a diagrammatic view of an internal combustion engine and the cooling system therefor.

Turning now in greater detail to the drawing there is shown in FIGS. 1–3 a liquid cooled internal combustion engine 10 having a radiator 12 and a liquid coolant deareation (degassifier) and overflow bottle 14. As best understood by reference to FIG. 3, the members 10, 12, and 14 are hydraulically interconnected to one another by fluid conducting lines 16, 18, 20, 22.

From FIG. 3, it can be seen that the engine is supported within the engine compartment of the vehicle by resilient motor mounts 24 secured on vehicle frame structure 25 while the separate coolant bottle 14 is mounted by brackets 26 to fixed vehicle structure 28. As seen best from FIGS. 1 and 2, the coolant bottle is only slightly higher in elevation as compared to the engine because of the constraints of the vehicle body work exemplified by the low hood lines diagrammatically shown by dashed line 30. The level of coolant extending into the coolant bottle fill neck is represented by line A while the level of the fluid in the engine is represented by the lower line B.

Since coolant fill equipment powered by pressure or activated by another power source is generally not available or used by vehicle owners, service garages, or even repair shops, the present filling apparatus and system provides an economical, highly efficient coolant filling aid which is readily affordable and which can be easily used by service personnel or a person having only ordinary mechanical skill. This invention accordingly provides optimized field service of the coolant system of automotive vehicles.

In FIGS. 4–7, a preferred embodiment of the coolant filling aid 34 is shown. The filling aid is a one piece unit molded from suitable plastic material having a generally funnel-like configuration with an upper conical portion 38 that connects into a column-like cylindrical body portion 40. The body portion 40 in turn connects to lower cylindrical cap portion 42. The cap portion 42 includes a cylindrical skirt 44 that terminates in a lower edge portion having a pair of opposing retainer tabs 46 that extend radially inward toward one another for attachment to a fill opening 48 of the coolant bottle 14. The coolant bottle's fill opening 48 is configured essentially the same as a typical fill opening for a vehicle radiator. A radiator's fill opening has elements which are typically formed of brass or other suitable metal integral with the inlet tank of the radiator.

Figure 4A:
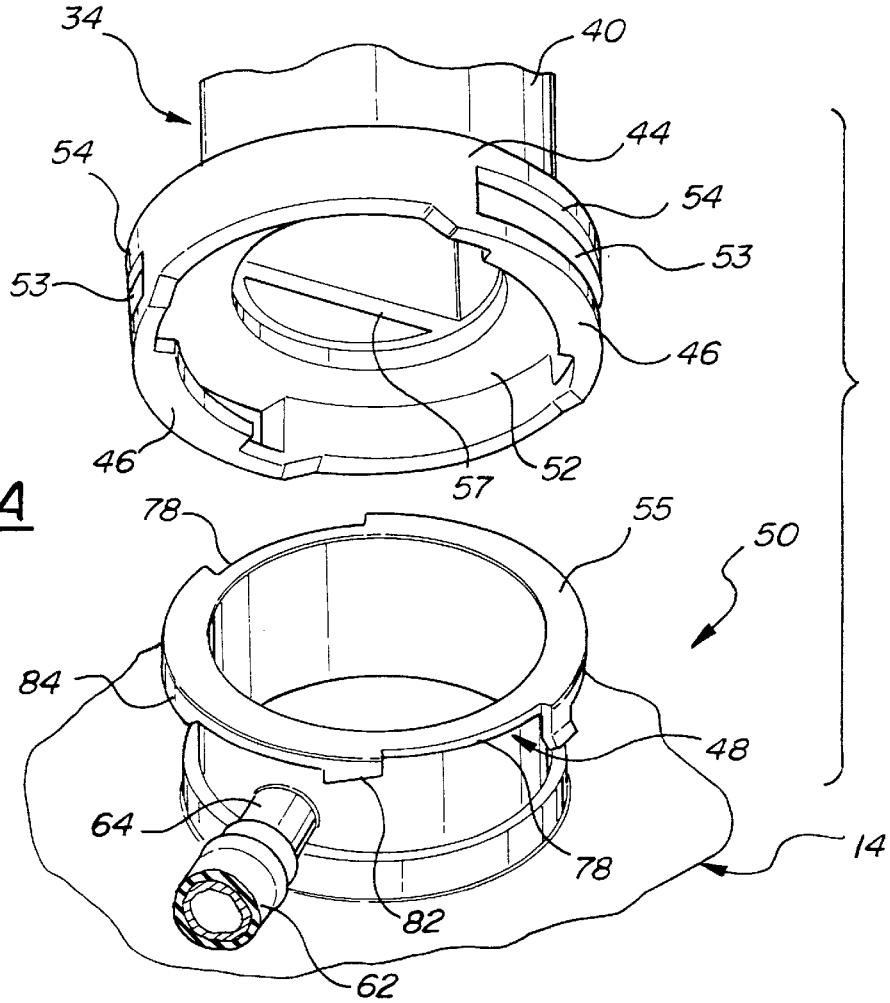
FIG. 4A is pictorial view of the filling aid of FIG. 4 being installed on the filler neck of the coolant bottle of FIGS. 3 and 4.

As can be seen in FIG. 3A, the subject fill opening assembly 48 on the coolant bottle is composed of elements molded of plastic combined with a mechanically attached metal throat portion. The filler opening assembly 48 includes a metal filler neck forming member 50 of generally tubular configuration with opposite edges fastened to the coolant bottle by crimped or spun-over portions. As best seen in FIG. 4A, the tubular member 50 forms an edge flange or bayonet lock portion 51 which extends radially outward for the purpose to be described hereinafter.

Fitted within the confines of the cap portion 42 of the coolant filling aid is a flat washer-like seal member 52 having radial retainer tabs 53 of a suitable elastomeric material which provides a resilient sealing element between the filling aid 34 and an upper annular sealing surface 55 formed by the member 50 in the filler neck assembly 48. As shown, the retainer tabs 53 extend radially into seal retention windows 54 formed in skirt portion 44 of the cap portion 42. It is contemplated that in another embodiment the seal 52 can be eliminated and sealing can be effected between the sealing surface 55 of the opening and the facing interior surface of the cap portion 42. Also, the bayonet connection provided by the edge flange 51 would have appropriate cam surfaces to force the sealing surfaces together in a fluid tight manner when the filling aid is installed on the fill neck.

Figure 7:
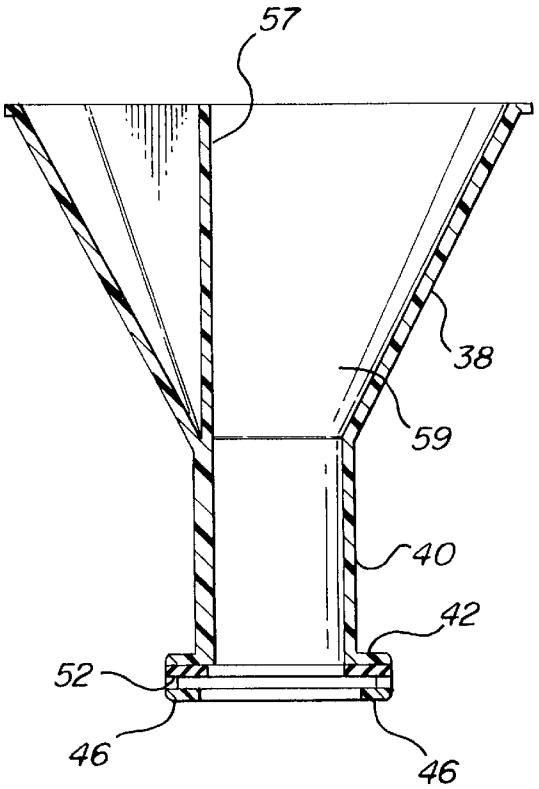
FIGS. 6 and 7 are cross sectional views of the coolant filling aid taken respectively along sight lines 6—6 and 7—7 of FIG. 5.
Figure 6:
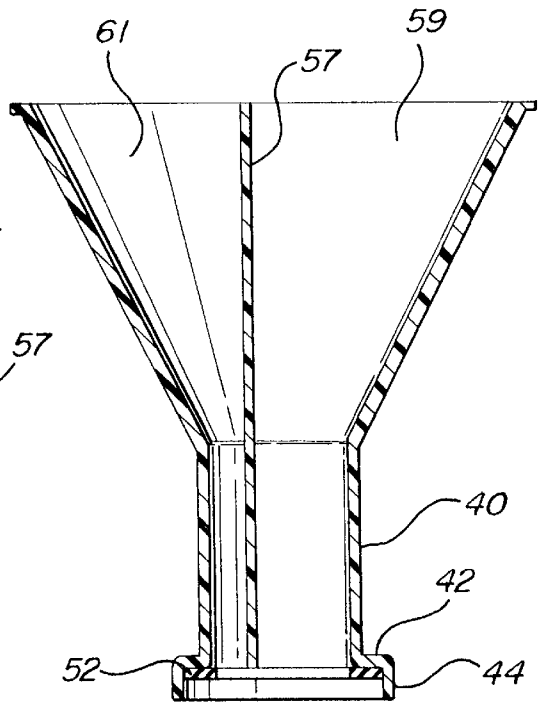
Figure 5:
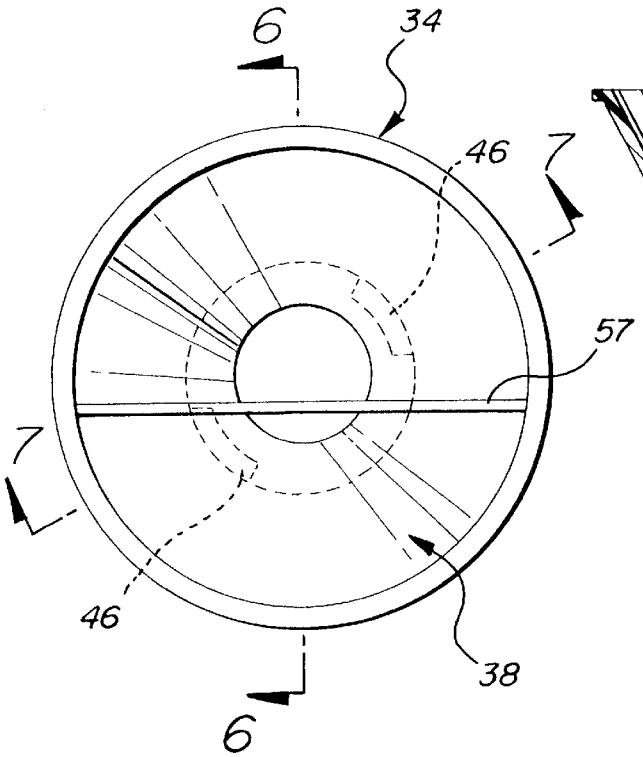
FIG. 5 is a top view of a coolant filling aid according to this invention.

Referring to the filling aid 34, a transverse divider wall 57 is provided in the interior of the device as shown best in FIGS. 5–7, provide a separate coolant fill section 59 and an air escape section 61.

Figure 4:
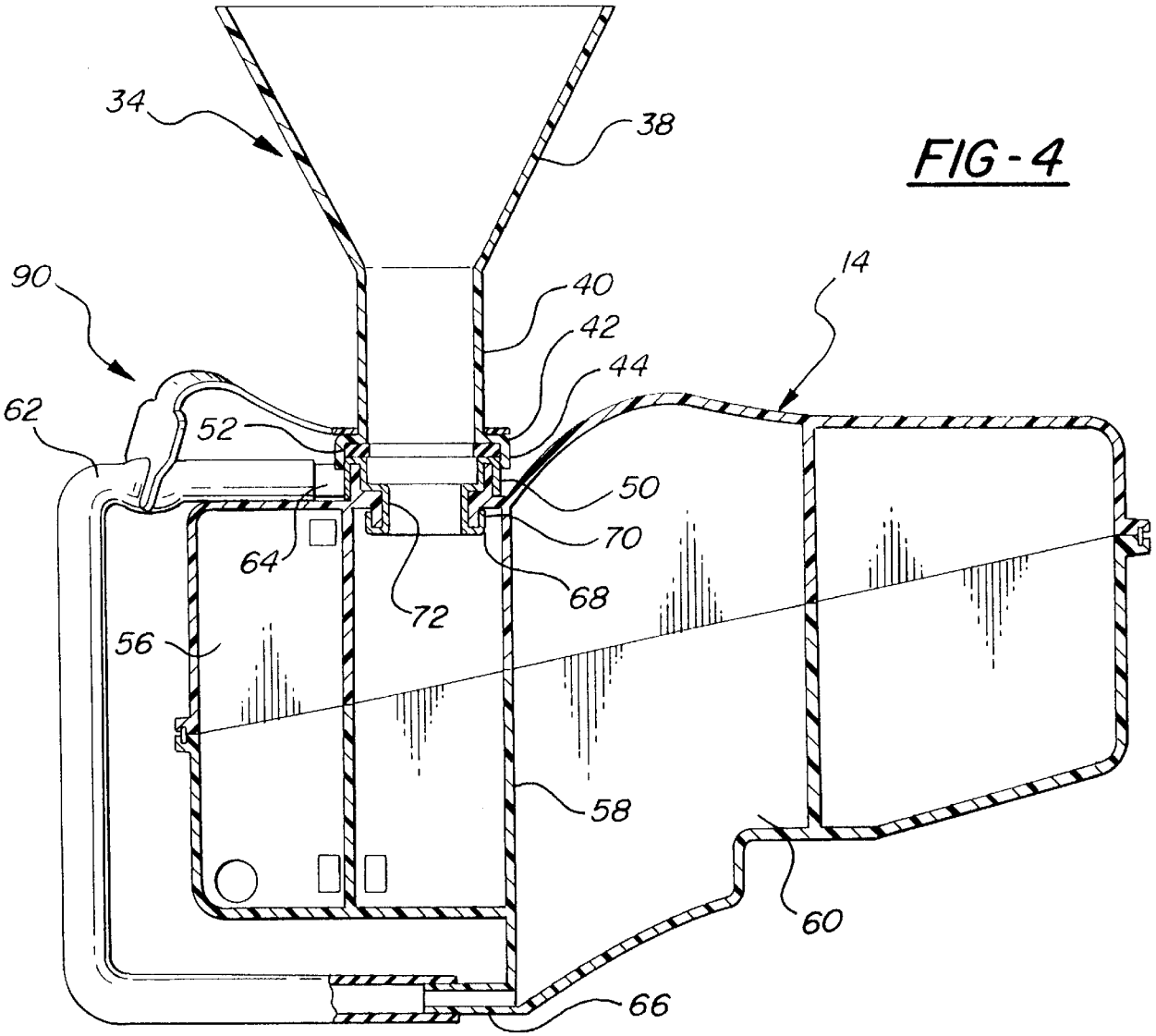
FIG. 4 is a sectional view of the filling aid of this invention installed on the filler neck of the coolant bottle of FIGS. 1 and 2.

Details of the coolant bottle itself is better furnished and described in my U.S. Pat. No. 5,680,833 which issued Oct. 28, 1997, for a "COMBINATION LIQUID COOLANT DEAREATION AND OVERFLOW BOTTLE, which is hereby incorporated by reference. As seen in FIG. 4, the coolant bottle 14 is preferably a plastic unit comprised of a coolant deareation or degassifier chamber 56 hydraulically separated by a pressure wall 58 from an overflow chamber 60. These discrete chambers are arranged in a lateral side-by-side configuration but are hydraulically interconnected to one another by a flexible hose 62 of elastomer material extending from radial overflow nipple 64 extending externally of the bottle from the filler neck opening assembly 48 to a inlet nipple 66 to the overflow chamber 60. The fluid seal formed between the filling aid 34 and the coolant bottle fill neck opening 48 is importantly above the overflow nipple 64 as seen in FIG. 4.

When an engine is at ambient temperature, coolant will normally be present only in the deareation or degassifier chamber 56. The overflow chamber 60 is designed to normally be empty and is used only to recover coolant at higher temperatures caused by expansion of the liquid with increased temperature. The fill neck opening assembly 48 is formed by the generally cylindrical metallic tubular element 50 preferably of brass or other suitable material. The member 50 has a stepped wall configuration with a reduced diameter midportion with opposite ends 68, 69 secured by being turned or coined over an annular collar potion 70 of the neck opening assembly 48 to the deareation or degassifier section 56 of the coolant bottle 14.

As best shown in FIGS. 4 and 5, the upper end of the fill neck opening assembly 48 provides flat annular sealing surface 55 which cooperates with the ring seal 52 to effectively provide fluid sealing between the filling aid 34 and the deareation or degassifier chamber 56 of the coolant bottle 14 when the filling aid is securely attached thereto as in FIG. 4.

In the preferred embodiment, sealing between surface portions 52 and 55 is obtained by the bayonet type connecting assembly 51 which is structurally similar and functionally identical to the bayonet connection universally used to connect a typical radiator cap 76 to a radiator tank. Such a connection is suitable for the filling aid 34 as shown in FIGS. 3A and 4A. With this connection, an outer annular rim portion 51 of the member 50 has a pair of diametrically opposed recesses 78 adapted to receive inwardly extending tab portions 46 formed on the filling aid apparatus 34. Next, the filling aid apparatus 34 is manually turned clockwise so that opposing camming and retention ears 82 (only one visible in FIG. 4A) of the bayonet edge portion 51 engages the tab portions 46 of the fill aid apparatus 34. Rotation causes the cam and tab portions 46, 82 to draw the fill apparatus 34 downward into a desirable engagement of seal 52 to surface 55. This operation establishes an initial, first rotational position of the apparatus 34 relative to the filler neck opening assembly.

The above described operation attaches the members 34 and 48 together but full sealing and stabilization of the filling aid apparatus 34 is not yet achieved. Further rotation of the apparatus 34 in the clockwise direction causes a pair of camming ramps 84 to engage tab portions 46 of the filling apparatus 34. The camming ramps 84 are located radially from one another and are spaced circumferentially from the retention ears 82. Engagement between the cam ramps 84 and tab portions 46 exert a downward force on the filling apparatus 34 to load seal 52 and thus effect an optimal seal between the portions 52 and 55.

The filling apparatus 34 is accordingly attached to the filler neck opening assembly 48 of the coolant bottle as an initial step for filling a cooling system in the field. Then, a one-piece clip 90 is employed to close the overflow hose 62 which runs between the two sections 56, 60 of the coolant bottle. The clip 90 is made of plastic material and is fastened by the strap 91 to the filling aid apparatus 34. Referring to FIG. 3, a cooling bleed valve 92 on the engine, if utilized is then opened. Such a bleed valve can typically be found on the intake manifold 94 of the engine. Next, coolant is poured from a suitable supply container into the enlarged conical section 38 of the filling aid apparatus 34 to begin the operation of completely filling an engine cooling system. During this initial filling operation, the bleed valve is observed for a coolant level. When the coolant level is even with the opened bleed valve 92, air which would otherwise be trapped in the cooling system is expelled. The bleed valve 92 is then closed and additional coolant is added to the filling aid apparatus 34, preferably to a fluid level up to the top of the fill apparatus. The engine cooling system subsequently is completely filled in a short period of time. Correct filling of the system is evident when the coolant level observed in the filling aid apparatus remains at a fixed level. Next, the clip on the overflow hose is removed allowing excess coolant in the filling aid apparatus to drain through the overflow nipple 64, overflow hose 62, and fitting 66 into the overflow section 60 of the coolant bottle. The filling aid apparatus is then removed and replaced by the conventional pressure cap 76, as shown in FIG. 3A. The engine cooling system is now pressure sealed and is operative to push any remaining air into the coolant bottle within a short time, i.e., about a half an hour of normal driving of the vehicle.

While a preferred embodiment of the invention has been shown and described, other embodiments will now become apparent to those skilled in the art. Accordingly, this invention is not to be limited to that which is shown and described but by the following claims.

What is claimed is:

1. In combination, a coolant filling aid and a coolant receiving vessel for augmenting the supply of liquid coolant to the cooling system of an internal combustion engine in an automotive vehicle, said coolant receiving vessel being an operative part of said cooling system, said vessel having a body for containing liquid coolant for said system and having a coolant fill neck extending upwardly from said body providing and inlet passage for the feed of liquid coolant into said body of said vessel and thereby into said cooling system of said engine, said neck having a flattened and annular sealing surface on the uppermost end thereof disposed around said sealing surface, said coolant filling aid having an uppermost end defining an opening for receiving a quantity of coolant supplied and further having a main body portion for holding said coolant at a level above the level of the coolant in said vessel and still further having an annular cap portion for connection with said neck and defining the terminal end thereof, an annular fluid sealing washer retained within said cap portion for directing sealing engagement with said upper sealing surface of said filler neck, said cap portion and said uppermost end of said neck having cooperating bayonet lock construction for camming said cap portion onto said uppermost end of said filler neck so that said seal seats in a fluid tight manner onto said sealing surface of said neck and said filling aid is rigidly retained on said neck and to further provide a releasable lock so that said filling aid can be subsequently detached from said neck, said filler neck of said vessel has a discrete overflow chamber for receiving fluid coolant over flowing from said vessel, said filler neck having an overflow nipple to provide an opening for discharging surplus coolant supplied to said coolant receiving vessel, a fluid conducting hose of resilient material operatively connecting said nipple to said overflow chamber, and a clip for selectively gripping and pinching said hose to block coolant flow through said hose when coolant is being added to said system through said filling aid and subsequently releasing said hose and freeing the hose for coolant to flow therethrough when said system is filled so that any excess in said filling aid can drain through said nipple and said hose into said overflow chamber.

* * * * *